US007046225B2

(12) United States Patent
Chou

(10) Patent No.: US 7,046,225 B2
(45) Date of Patent: May 16, 2006

(54) LIGHT EMITTING DEVICE DISPLAY CIRCUIT AND DRIVE METHOD THEREOF

(76) Inventor: Chen-Jean Chou, 21 Ridgefield Rd., New City, NY (US) 10956

( * ) Notice: Subject to any disclaimer, the term of this patent is extended or adjusted under 35 U.S.C. 154(b) by 0 days.

(21) Appl. No.: 11/161,499

(22) Filed: Aug. 5, 2005

(65) Prior Publication Data

US 2006/0028407 A1 Feb. 9, 2006

Related U.S. Application Data

(60) Provisional application No. 60/522,045, filed on Aug. 6, 2004.

(51) Int. Cl.
*G09G 3/36* (2006.01)

(52) U.S. Cl. ..... 345/92; 345/82; 345/76; 345/214; 345/212

(58) Field of Classification Search ..... None
See application file for complete search history.

(56) References Cited

U.S. PATENT DOCUMENTS

| | | | | |
|---|---|---|---|---|
| 5,408,109 | A | 4/1995 | Heeger et al. | 257/40 |
| 5,482,896 | A | 1/1996 | Tang | 438/28 |
| 5,663,573 | A | 9/1997 | Epstein et al. | 257/40 |
| 5,684,365 | A | 11/1997 | Tang et al. | 315/169.3 |
| 5,952,789 | A | 9/1999 | Stewart et al. | 315/169 |
| 6,157,356 | A | 12/2000 | Troutman | 345/28 |
| 6,501,466 | B1 | 12/2002 | Yamagishi et al. | 345/204 |
| 6,580,408 | B1 | 6/2003 | Bae et al. | 345/76 |
| 6,618,030 | B1 | 9/2003 | Kane et al. | 345/82 |
| 6,621,100 | B1 | 9/2003 | Epstein et al. | 257/40 |
| 6,686,699 | B1 | 2/2004 | Yumoto | 315/169 |
| 6,693,388 | B1 | 2/2004 | Oomura | 315/169 |
| 2004/0227706 | A1* | 11/2004 | Sung | 345/76 |

* cited by examiner

*Primary Examiner*—Tuyet Thi Vo

(57) ABSTRACT

A driving scheme and pixel circuits therein for active matrix light-emitting device displays are provided. The driving scheme is structured to perform both line selection of and power delivery to the pixels via the same scan-power electrode, as opposed to conventional approach where scanning and drive are performed via separate access lines, thereby allowing more compact pixel design and better utilization of light emitting area. Furthermore, this driving scheme provides a dynamic reference for the active elements in a pixel, creating a different design concept and greater flexibility for pixel circuits. Embodiments of pixel circuits employing this driving scheme are exemplified in this disclosure.

33 Claims, 10 Drawing Sheets

LIGHT EMITTING DEVICE DISPLAY CIRCUIT AND DRIVE METHOD THEREOF

CROSS REFERENCE

This application claims the priority of U.S. Provisional Patent Application No. 60/522,045, filed on Aug. 6, 2004, which is herein incorporated by reference.

BACKGROUND OF THE INVENTION

1. Field of the Invention

The present invention relates to the pixel circuit and a driving method of an active matrix display comprising light-emitting devices which emits light by conducting a driving current through a light emitting thin film such as an organic semiconductor thin film, and thin film transistors for controlling the light emitting operation of the respective light emitting devices. A preferred embodiment of the present invention applies to light emitting devices formed with organic material, the organic light emitting diode (OLED). More specifically, the present invention provides a method and structure to address and deliver the driving power to a pixel using multi-functional access lines, thereby simplifying the array structure of a light emitting device display and the fabrication process thereof, and increasing the fill factor of light emitting area.

2. Description of the Prior Art

Organic light emitting diode displays have attracted significant interests in commercial application in recent years. Its excellent form factor, fast response time, lighter weight, low operating voltage, and prints-like image quality make it the ideal display devices for a wide range of application from cell phone screen to large screen TV. Passive OLED displays, with relatively low resolution, have already been integrated into commercial cell phone products. Next generation devices with higher resolution and higher performance using active matrix OLEDs are being developed. Initial introduction of active matrix OLED displays have been seen in such products as digital camera and small video devices. Demonstration of OLED displays in large screen sizes further propels the development of a commercially viable active matrix OLED technology. The major challenges in achieving such a commercialization include (1) improving the material and device operating life, and (2) reducing device variation across the display area. Several methods have been suggested to address the second issue by including more active switching devices in a pixel, or by switching of supply lines externally. A common theme of these solutions is an increase of device complexity. The present invention addresses the complexity issue by structuring the pixel so that a conventional scanning electrode is configured as a current supply electrode to the light emitting device in part of a cycle to deliver full drive power, without adding to the circuit any additional switching electrode or signals.

Examples of using organic material to form an LED are found in U.S. Pat. Nos. 5,482,896, 5,408,109, and 5,663,573, and examples of using organic light emitting diode to form active matrix display devices are found in U.S. Pat. Nos. 5,684,365 and 6,157,356, all of which are hereby incorporated by reference.

An active matrix OLED display (FIG. 1) is typically structured with "SELECT" electrodes for row select, "DATA" electrodes for setting the pixel state, power electrodes VDD to drive the pixels, and a reference voltage. A basic pixel in an active matrix display also contains at least one transistor for data control, and at least a memory element to hold the data sufficiently long so a pixel remains stable in a frame. A circuit diagram for a basic pixel 100 in an active matrix OLED display is depicted in FIG. 2 in further detail. An active matrix with pixel circuit structured similar to FIG. 2 allows data to be written and retained in a storage capacitor 204 according to the data signal delivered in an address cycle, while the power supply VDD continuously drives OLED 205 through an n-channel transistor 201, according to the data setting in capacitor 204. The selection of pixels to receive data information is controlled by an n-channel transistor 203 that is controlled by the voltage on a select electrode connected to the gate of transistor 203. An active matrix driving scheme allows the drive transistor 201 remain in a data state for an extended period of time after the address cycle, the peak current required for achieving a brightness level is reduced accordingly compared to a passive matrix. Its peak driving current does not scale with the resolution, making it suitable for high resolution applications. Stability of the display is also improved appreciably.

FIG. 2*b* illustrates a similar construction of an active matrix light emitting device display with n-channel drive transistor 201*b*, n-channel data control transistor 203*b*, capacitor 204*b*, and light emitting diode 205*b*.

Noticeable in both FIGS. 2 and 2*b*, the pixel circuits are structured as common-cathode where the cathode of the light emitting diode is connected to a common voltage line shared by other pixels. Where in FIG. 2 the data signal is written into the capacitor referencing to a constant VDD, the actual drive control voltage, gate-to-source voltage ($V_{GS}$), that determines the current in the drive transistor is affected by the voltage across the light emitting diode according to, since the source terminal of the drive transistor floats on the light emitting diode. Where in FIG. 2*b*, the data signal is written into the capacitor being directly affected by voltage across the light emitting diode according to $V_{GS}=V_{DATA}-V_{LED}$. In another word, in both of these examples, the gate voltage can not be directly referenced to the source of the transistor. The drive voltage is unavoidably interfered by the voltage across the light emitting diode. This illustrates a commonly know compromise between common-cathode structure and source-referencing scheme in a light emitting diode display pixel.

As illustrate in the above example, the electrical current for producing light output flows through at least a control element that regulates the current. In a conventional light emitting device display, these control elements are fabricated on a thin film of amorphous silicon on glass. Power consumed in such control elements are converted to heat rather than yielding any light. To reduce such power consumption, polycrystalline silicon is preferred over amorphous silicon for its better mobility. More elaborated methods employing self-regulated multiple-stage conversions suitable for pixel circuit using polysilicon base material may be found in U.S. Pat. Nos. 6,501,466 and 6,580,408. These methods provide a current drive scheme while largely eliminated the impact from material and transistor non-uniformity typically associated with thin film polysilicon on glass. In these methods, typically a minimum of four transistors are required to achieve such self-regulated, multi-stage conversion to achieve a pixel-independent current drive for the display. An example of such methods is illustrated in FIG. 3. where four transistors 301, 302, 303, and 307, and 3 access lines, DATA, SELECT, and VDD, are used for each pixel with a storage capacitor 304 and an OLED 305.

The present invention provides a multi-functional scan-power electrode for pixel access that carries the conventional pixel select function and power delivery function on the same bus line, thereby allowing a reduction in display complexity. The pixel structure so constructed comprises a direct current path from scan-power electrode to the light emitting element, the turning-on and off of which are fully controlled by the voltage applied on said scan-power electrodes.

SUMMARY OF THE INVENTION

This invention is used in the operation of an active matrix display comprising light emitting elements.

As described in the background, the conventional pixel structures and the operating method of a light emitting device display involves a scanning electrode (or referred to as such different names as SELECT or GATE line) and a power supply electrode (VDD). The scanning electrode connects to a pixel through the high impedance gates of control transistors in the pixel. Such scanning electrodes did not operate to supply a major part of the drive current to the light emitting device for producing light output, nor did such prior art pixel structures operate with any direct conducting path from a scanning electrode to the light emitting device.

The present invention provides a method to operate a light emitting device display wherein the drive power is delivered via the same scanning electrodes that perform pixel selection for data input. A pixel circuit and drive method are provided to allow a scanning electrode (now named as scan-power electrode in this invention) performs a dual functions of selecting and controlling data input to the pixel, and delivering drive current to the light emitting element in the pixel. Furthermore, such direct current paths provided by the control circuit in a pixel in this invention is fully controlled by the signal voltages applied to said scan-power electrodes without relying on additional control signals operated on separate control lines. Alternating direct current paths are thus created via the same scan-power electrodes, and a drive current in full capacity is delivered to the light emitting elements, rather than assisting in part to reduce the resistance of another main power delivering electrode, without having to distinctively switching the power electrodes.

In summary, the present invention provides pixel structures and a drive method to operate a light emitting device display by dual functional scan-power electrodes, where each of such scan-power electrodes operates to perform line selection in a data input cycle, and operates to deliver drive power in a drive cycle. The pixel circuits so provided possess both structural distinction and functional distinction. One structural distinction is that a direct current path from a scan-power electrode to a voltage source via a light emitting element is provided. Such direct current path is enabled or disabled depending on the voltage applied to said scan-power electrodes, and may be further modulated by the data information. No additional switching mechanism is involved in such operation. As another structural distinction is that the display so constructed operates without a separate power electrode for delivering drive current; the drive current is deliver in whole during a period of operation via a scan-power electrode. A functional distinction is that the drive current needed for a light emitting device according to data information is delivered in full capacity, not relying on any other means, via a scan-power electrode. Furthermore, the present invention demonstrates in a preferred embodiment a pixel configuration in common-cathode, common-source, with n-channel drive transistor.

DETAILED DESCRIPTION OF THE INVENTION

Figure 1:
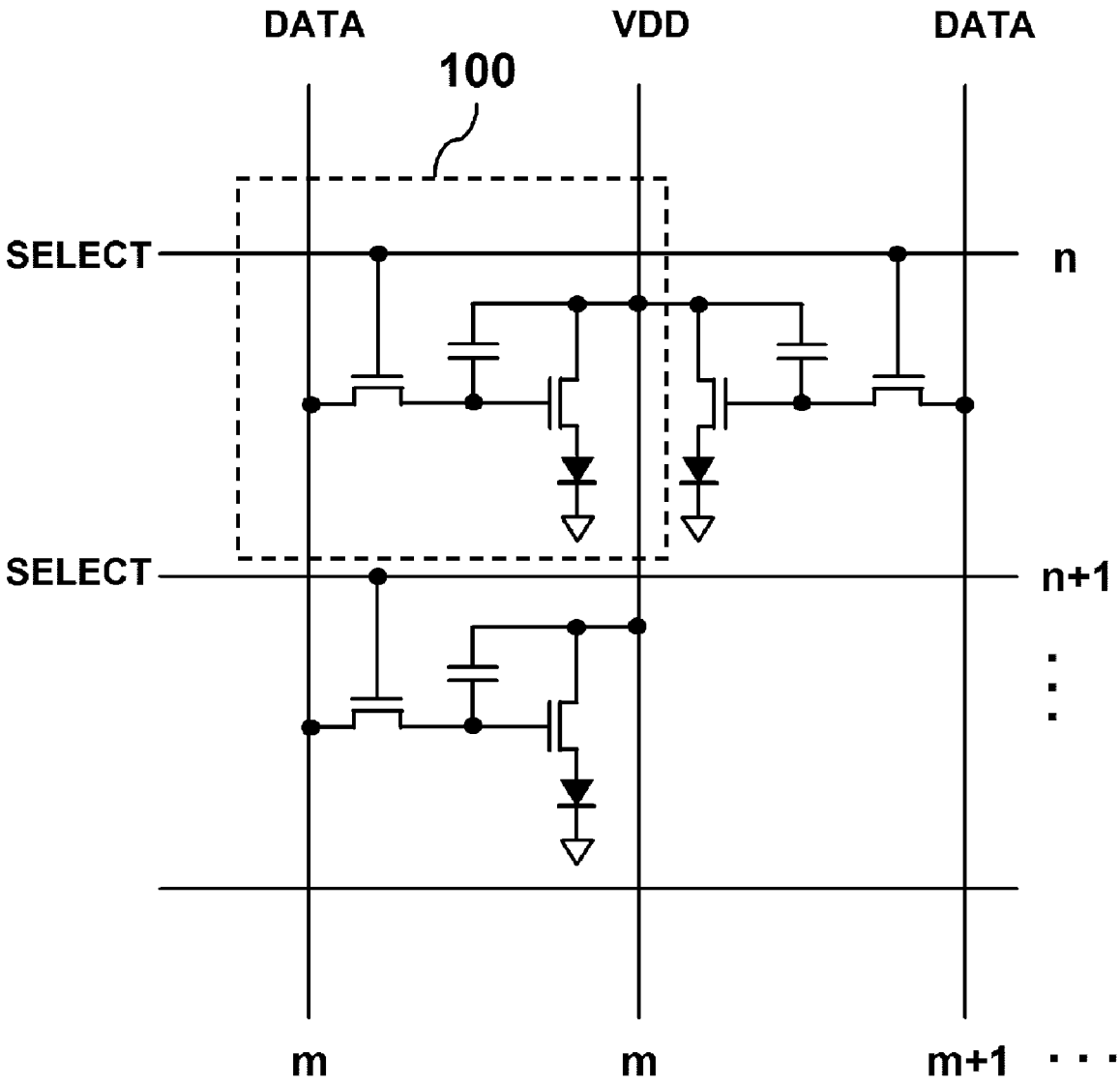
Fig. 1 (Prior Art)
FIG. 1 is a schematic diagram of a prior art active matrix light emitting device.

Preferred embodiments of the present invention are herein described using organic light emitting diodes as illustration. Examples of using organic material to form an LED are found in U.S. Pat. Nos. 5,482,896 and 5,408,109, and examples of using organic light emitting diode to form active matrix display devices are found in U.S. Pat. Nos. 5,684,365 and 6,157,356, all of which are hereby incorporated by reference.

As evidenced in the prior art, the conventional method of constructing and operating a light emitting device display involves a scanning electrode (or referred to as SELECT line, GATE line, or other names carrying similar meaning) and a power supply electrode (VDD). The scanning electrode interacts with a pixel through high impedance gates of switching elements in the pixel and does not participate in delivering of drive current to the light emitting device.

The present invention provides a method to drive light emitting device in an active matrix display without explicit power electrodes. This method is made possible by constructing specific pixel circuits so that the drive current is delivered via a scanning electrode without interfering with the scanning operation performed by a scanning electrode. A pixel so constructed utilizes a scan-power electrode that delivers drive current while inhibiting data input in one period, and enables data input according a scanning signal in another period. A pixel so constructed comprises direct current paths from a scan-power electrode, the enabling and inhibiting of which are fully controlled by voltage signals applied to the scan-power electrode.

In the description of this invention, a direct current path represents a path that conducts direct electrical current when enabled, and is enabled in at least one of the operation periods of a display. A direct current in a pixel circuit is an electrical current not ended on or via a capacitor in said circuit; such current thus shall not be entirely from charging and discharging of capacitive elements in a pixel or other transient charging current. The capacitive elements in a pixel circuit include explicit capacitor structures such as parallel conductive plates, and parasitic capacitive components such as those arising from capacitive coupling between the input gate or base and the body of a transistor. The small control current into the high-impedance control nodes of a switching device (for example, gate current in an MOS device or base current in a bipolar transistor) is also excluded from the consideration of direct current. In other words, a direct current path so defined is a current path capable of conducting a sustained and significant current under biasing conditions consistent with operation of a display. Specifically, the conductions merely due to leakage, charging or discharging the parasitic elements in transient state, or a path via or ended on a capacitor are excluded from the definition of direct current path. An integrated circuit contains various types of parasitic components, such as gate-to-source capacitance, drain-to-substrate junction capacitance, and junction leakage paths. For example, the overlapping between the gate and the source region of an MOS transistor forms a parasitic gate-to-source capacitor, which is inherently connected to the gate and source in its own structure. Transient current and leakage current may arise from conduction through such components. These parasitic conducting paths are excluded from being a valid direct current path in this definition. On the other hand, a direct current path as defined may be a conduction path that is modulated by a transistor according to the gate voltage of the transistor. A direct current path so defined is thus a structure that may comprise transistors (via source-drain or emitter-collector), resistors, and diodes, connected in a manner that allows current flow in at least part of the operation.

A scan-power electrode represents an access line that is structured to perform both a scanning operation where a scanning signal is delivered to enable data input in selected pixels in one period of the operation, and a drive operation where a drive current is delivered to a light emitting device in another period of operation. A scanning electrode means a conventional access line that performs a conventional scanning (or select) operation only.

An organic light emitting diode is used in most preferred embodiments wherever appropriate; the presence of such a device in such examples should not be construed as setting forth a limitation on the present invention directed for light emitting devices in general. The MOS devices are used as a preferred embodiment for the switching elements. Similar bipolar transistors perform equal functions as MOS devices.

Preferred embodiments of the present invention will hereinafter be described in detail with reference to the drawings.

Figure 4:
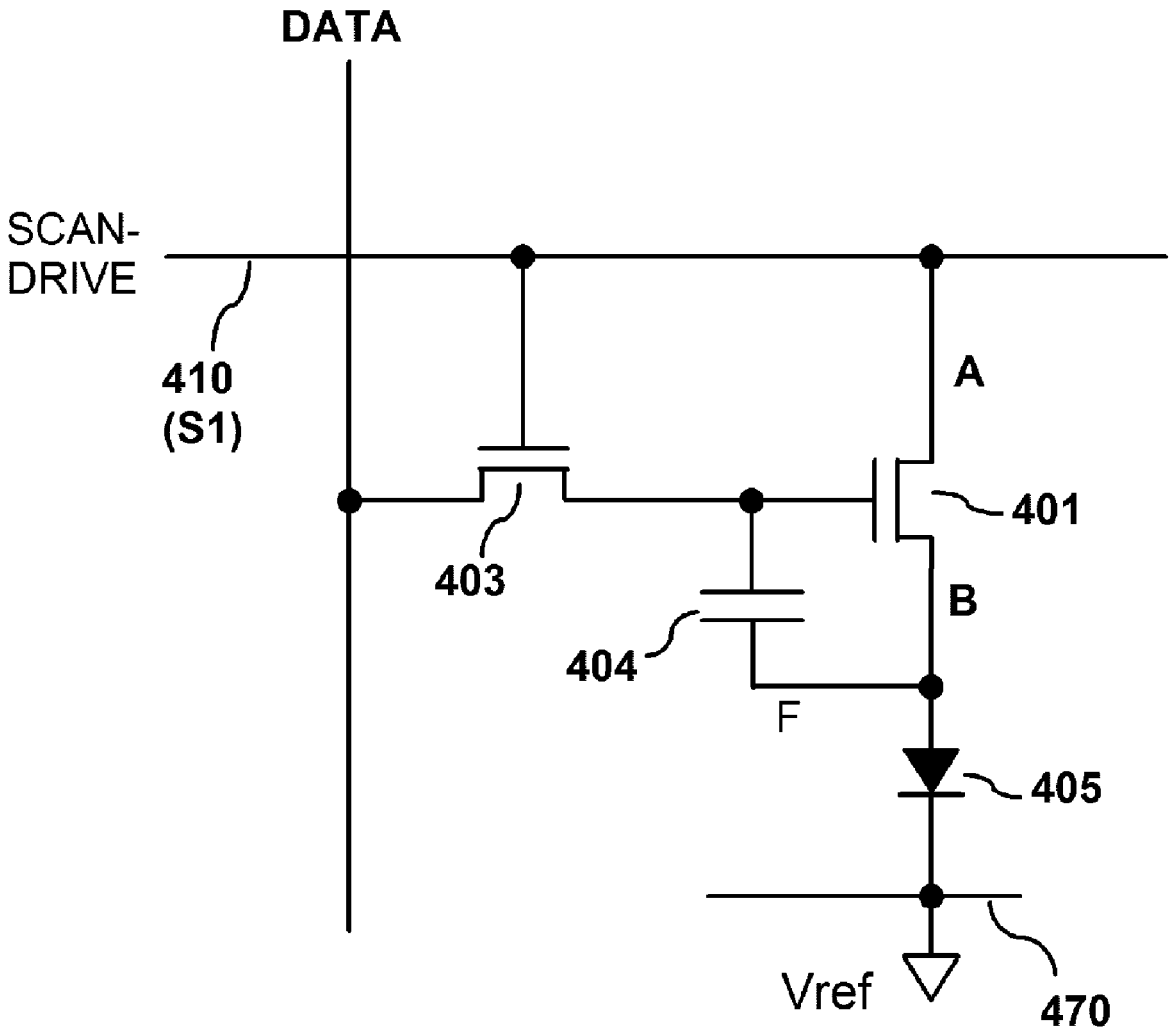
FIG. 4 is a pixel circuit in a preferred embodiment of the present invention using a p-channel transistor for scan select, and an n-channel transistor for drive.

FIG. 4 provides an example of a preferred embodiment according to the present invention, wherein a pixel circuit comprises a p-channel transistor 403 for scanning control, an n-channel transistor 401 for drive control, a capacitor 404 for storing data information, an organic light emitting diode (OLED) 405, scan-power electrode 410, a reference voltage source Vref 470, and a data electrode. In the preferred configuration as shown, the cathode of OLED 405 is connected to Vref making this embodiment a common-cathode structure. The first terminal of capacitor 404 is connected to the gate of drive transistor 401, and the second terminal of the capacitor 404 is connected to a source/drain terminal B of transistor 401. The opposite source/drain terminal A of transistor 401 is connected to the scan-power electrode 410. The definition of terminals A and B as being a source or drain terminals, or vise versa, is determined by the voltage setting on scan-power electrode 410, dynamically. All voltage levels discussed herein reference to Vref 470.

In a preferred operation, Vref is set to be the lowest voltage (GND) in the system, and data information is formatted to positive values relative to GND. During a scanning cycle where data information is delivered through a data electrode to a pixel, the voltage on a scan-power electrode is set to GND. Since the gate of p-channel transistor 403 is at the lowest level, the p-channel transistor is turned on, allowing bidirectional current flow for data transfer between the data electrode and the storage capacitor 404. The direction of such data current is determined by whether the incoming data voltage is more, or less, positive than the existing data voltage in the capacitor. In such event, n-channel transistor 401 is turned on due to positive voltage on its gate, thereby keeping the conducting channel open in transistor 401 and allowing a conducting path from the second terminal of capacitor 404 to the scan-power electrode, which is set at GND during this cycle. Such an operating configuration provides a low GND level reference to the capacitor during data input. Any data information formatted using low GND reference is therein properly registered to a pixel using the same fixed reference voltage, and stored in the capacitor 404.

The duration of such address cycle is typically set to approximately one $N^{th}$ of the period assigned to refresh a display image. For example, for sixty frames per second refreshing rate on 100 horizontal lines, the addressing period is approximately 1/6000 of a second.

In a drive cycle, a scan-power electrode 410 is switched to a drive voltage (VDD) by a driver connected to the scan-power electrode. As a preferred operation, VDD is set to be the most positive voltage level in the system. More detailed discussion and numerical examples for setting VDD are provided in the subsequent paragraphs. The p-channel transistor 403 is thus turned off by a VDD on it gate, isolating the capacitor 404 and the gate of transistor 401 from the data electrode. The data received in a scanning cycle in a pixel is thereby retained on capacitor 404. A high positive voltage VDD on a scan-power electrode also provides a voltage source to bias transistor 401 into its operating point, and to forward bias OLED 405. The drive current via transistor 401 is then regulated by the data information stored at capacitor 404, which is connected to the gate of 401.

Note that in a drive cycle, transistor 401 is in a source-follower configuration with its gate-to-source voltage ($V_{GS}$) maintained by the capacitor (404) voltage, while in a scanning cycle, point B is brought to GND. The control voltage ($V_{GS}$) of 401 is thus a direct transfer of input signal without any influence from the forward characteristics of OLED 405.

In a preferred operating condition, the drive voltage VDD for a scan-power electrode is set to be equal to, or slightly higher than the sum of the maximum forward voltage of OLED and the dynamic range of input data. Such a VDD setting ensures the voltage drop from drain to source ($V_{DS}$) of 401 in a drive cycle is greater than $V_{GS}$, forcing transistor 401 into its saturation region, thereby providing full current control through $V_{GS}$ and eliminating any influence from variations of OLED. For a display comprising OLED operated in 4.5 to 8V forward voltage for light producing, and a data range between 0 and 3V, a proper setting for VDD will thus be about 11 to 12 volts. As another example, for a display comprising polymer LED that operates in 3 to 5.5V for light emitting, and a dynamic data range of 3.3V, a proper setting for VDD will then be about 9 to 10V.

Referring to FIG. 4, drive transistor 401 is considered having a varying configuration that is dynamically determined by the voltage on a scan-power electrode. In a drive cycle, terminal A of 401, being connected to a scan-power electrode that is set at the most positive voltage level, is a drain terminal. Current flows from drain terminal A through source terminal B, and through OLED 405 to Vref. In contrast, in a scan (write) cycle, terminal A is at the lowest voltage set by scan-power electrode 410. Any charging or discharging current directed toward capacitor 404 from the data electrode via transistor 403 is further directed toward terminal B. Transistor 401 remains in its on-state for any positive voltage accumulated on the capacitor. Terminal B thus operates as a drain when a charging current is directed into capacitor 404, or when a discharging is taking place to drain the excess stored charge. Terminal A, being kept at GND in a scanning cycle, operates as source and providing a fix GND reference to point F of capacitor 404, via transistor 401. This dynamically varying configuration scheme creates the possibility for the circuit of FIG. 4 to operate with an n-channel drive transistor in a common-cathode structure, without being influenced by OLED's characteristics.

Associated with a display pixel circuits of FIG. 4, an external driver circuit capable of (1) driving the scan-power electrodes in the voltage range provided in the above discussion, and (2) providing current capacity to deliver the required current in full capacity via scan-power electrodes according to the data requirement may be connected to the scan-power electrodes to perform the operations. A preferred driver for driving scan-power electrodes in the present embodiment will then require a 10 volts output capacity to properly operate the display. As a second requirement, a driver operating the scan-power electrodes in the present invention is required to provide a current capacity to deliver drive current to the light emitting elements in all pixels in a row when each one is set to the brightest level. For example, given the highest brightness at 10 micro amp. per pixel and 640 pixels per row, a scan-power electrode driver requires at least an output capacity of about 6.4 mA per channel in its drive state to properly operate the display. An external row driver designed for this purpose thus needs to have the conventional voltage sequence, with enhanced current output capacity by including larger transistors or power transistors in its output stage. Such external driver circuit may be, as commonly practiced in display industry, attached to the display panel as an integral part of the display.

As described in detail hereinabove, as a first perspective, the preferred embodiment comprises a scan-power electrode that controls the selection (scanning) of a pixel that involves data writing and data retaining by applying a first (scanning) signal and a second signal. The same scan-power electrode delivers drive current to the light emitting element during the period when the second (drive) signal is applied.

As described hereinabove, the preferred embodiment in FIG. 4 provides, as a second perspective, an illustration of the embodiment of a direct current path connecting said scan-power electrode and said reference voltage, via A-terminal and B-terminal of transistor 401. Such a direct current path conducts a drive current in said drive cycle according to the voltage held in the capacitor 404. It should be noted that various electrical elements may be further inserted in such a direct current path to further modify the operation. These further modifications does not violate the provision of a direct current path between a conventional scanning electrode and a voltage source to incorporate a drive function into the same scan-power electrode, as described in the present invention.

The preferred embodiment of FIG. 4 provides, as a third perspective, a demonstration of the functions of terminals A and B of transistor 401 as being drain and source vary in different operating cycles. The function of A and B terminals as being drain or source is not statically fixed at the time of design and implementation when connection and wiring are made, but rather depends on the operation voltage applied on said scan-power electrode. In this respect, it is more appropriate to refer to these terminals as second and third terminals (beside the gate terminal) that are dynamically assigned their functions (as drain or source) according to the operating voltages applied to the scan-power electrodes in different cycles in the operation.

The embodiment of FIG. 4 further provides, as a fourth perspective, a reference voltage equal to the scanning voltage for the second terminal (F) of capacitor 404 via transistor 401 during the time when such a voltage is applied on the scan-power electrode. This voltage repeats the same value each time when a scanning voltage is applied on said scan-power electrode, thereby providing a reference at a fixed voltage level for data writing. Terminal F of capacitor 404 is released to adjust itself according the operating point in a drive cycle where a voltage is determined by the current through OLED 405 and transistor 401.

An additional benefit demonstrated in this embodiment is a common cathode configuration while using a preferred n-channel drive transistor without being affected by the characteristics of the light emitting element. This operating configuration is made possible by the connection of capacitor to the node F between the drive transistor and the light emitting device, and a dynamic setting of such common node F as described above, the n-channel drive circuit is operable while allowing the cathode of the light emitting device connected to a common electrode. Such operation was not possible in previous drive schemes unless the forward voltage drop of a light emitting device is taken as part of the gate voltage.

It should also be noted that the operation of pixel circuit in FIG. 4 may be extend to a pixel circuit where the light emitting element is a bi-directional device. By replacing the light emitting element 405 with a bi-directional device, the same analysis and description above may be applied. Such pixel circuit and its light emitting function operate equally well. An example of forming a bi-directional organic light emitting device is found in U.S. Pat. No. 5,663,573.

In the embodiment of FIG. 4, the transistors may be thin film transistors formed on a layer of amorphous or polycrystalline silicon, or single crystal silicon substrate. The voltage reference is typically supplied through a continuous layer 470 of conducting material connected to each and every pixel. The organic light emitting diode may be formed with a stack of layers of small molecule or polymer organic materials. The data and scan-power electrodes are typically formed with coated conductive films and using standard photolithography-etch processing techniques.

Figure 10:
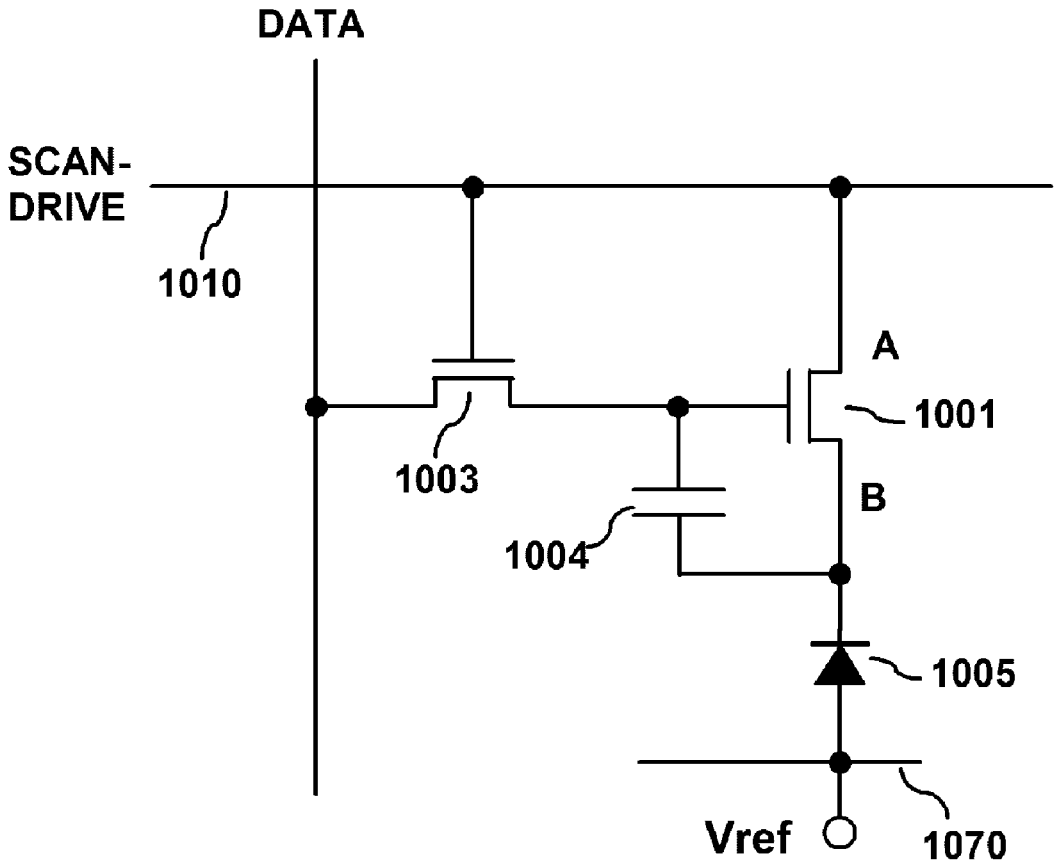
FIG. 10 is a schematic diagram of a pixel circuit, a variation from FIG. 4.

A variation from the embodiment of FIG. 4 is provided in an example in FIG. 10, wherein an n-channel transistor 1003 and a p-channel transistor 1001 are used. In a preferred operation, Vref is set to a most positive voltage in the system; scan cycle for writing data is initiated by setting voltage high on a scan-power electrode, and driving power is enabled by setting voltage low on a scan-power electrode.

Figure 5:
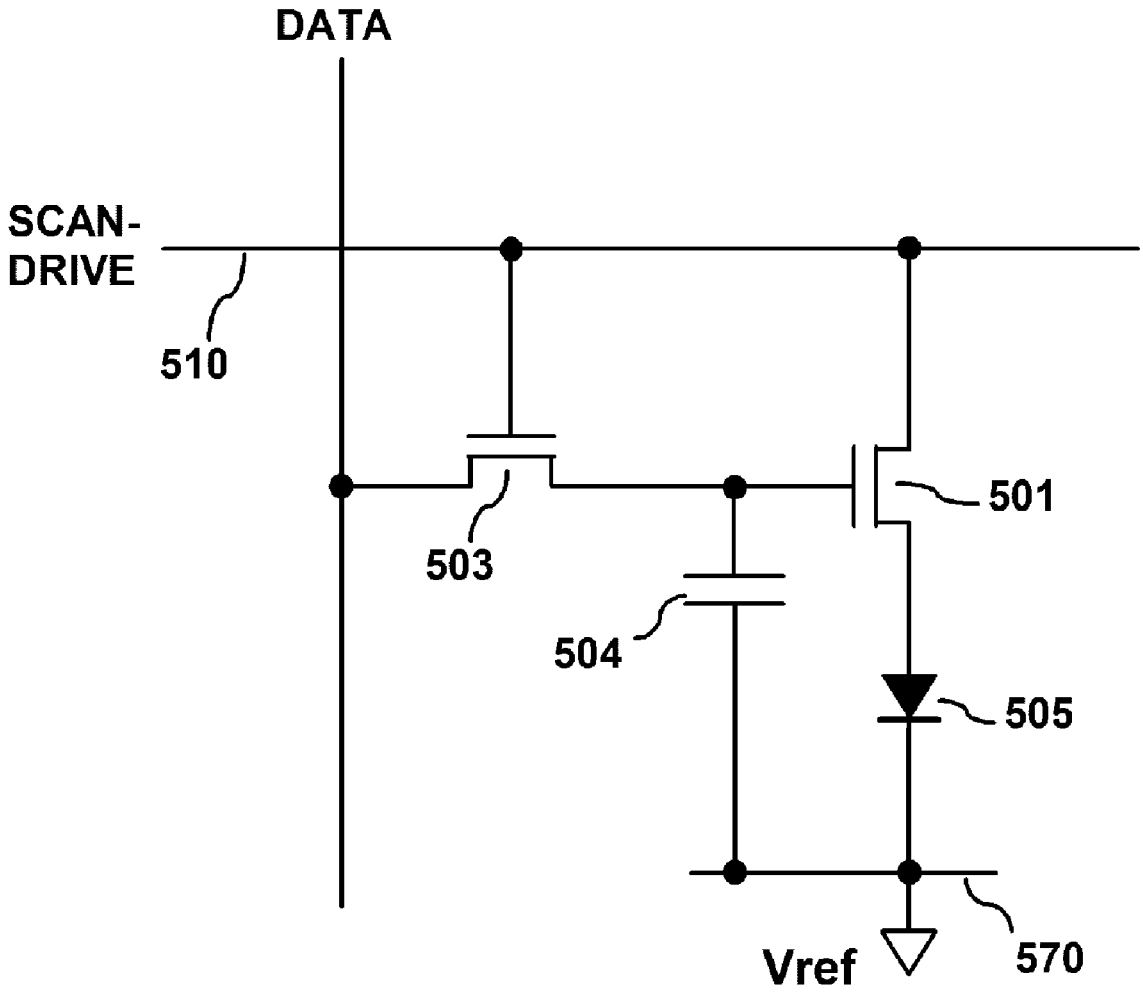
FIG. 5 is a pixel circuit in another embodiment of this invention.

FIG. 5 illustrates another alternative embodiment of FIG. 4 wherein capacitor 504 uses Vref 570 as its fixed reference voltage. During a scan (write) cycle, a scan-power electrode is set low, turning on p-channel transistor 503, and allowing data to be refreshed at the capacitor and gate of 501. The scan-power electrode is set high for drive cycle, turning off transistor 503, and forward biasing n-channel transistor 501.

Figure 2A:
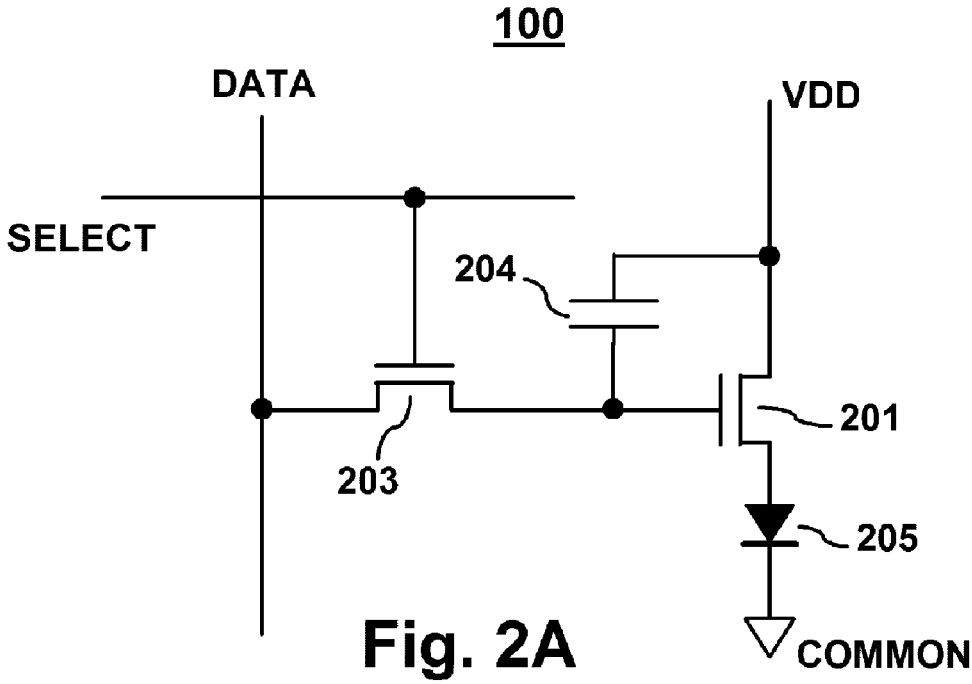
Fig. 2A (Prior Art)
FIG. 2 is a schematic diagram of a prior art pixel circuit in an active matrix light emitting device.
Figure 2B:
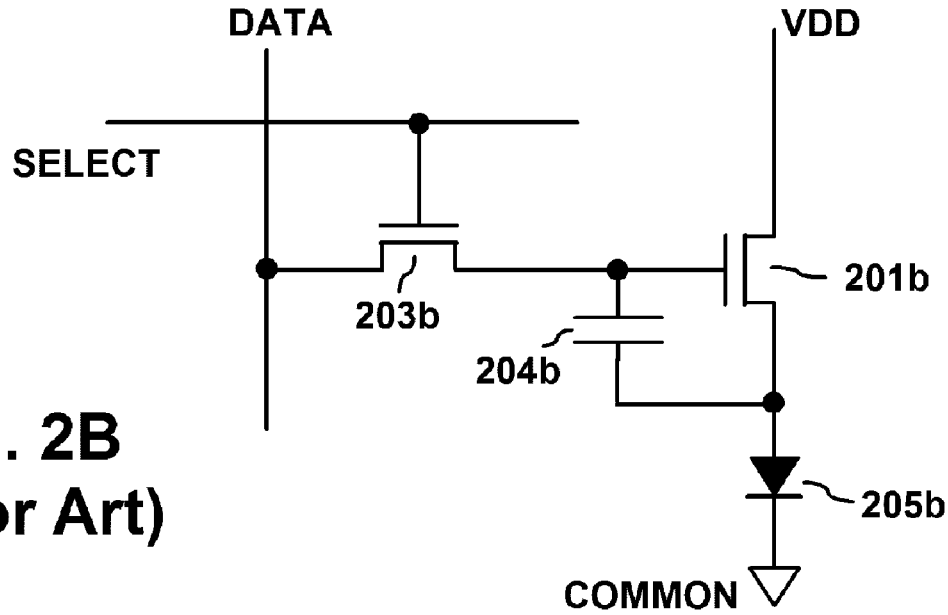
Fig. 2B (Prior Art)

The reference voltage for the capacitor is constant, and thus a faster response for writing data into the capacitor. In operating such circuit, the data voltage needs to be raised by an additional offset voltage approximately equal to the average onset voltage of OLED 505 to ensure transistor 501 is properly turned on and in its saturation region in a data input cycle. This embodiment operates in a similar manner as the pixel circuit provided in FIG. 2, but with one fewer access lines.

Figure 6:
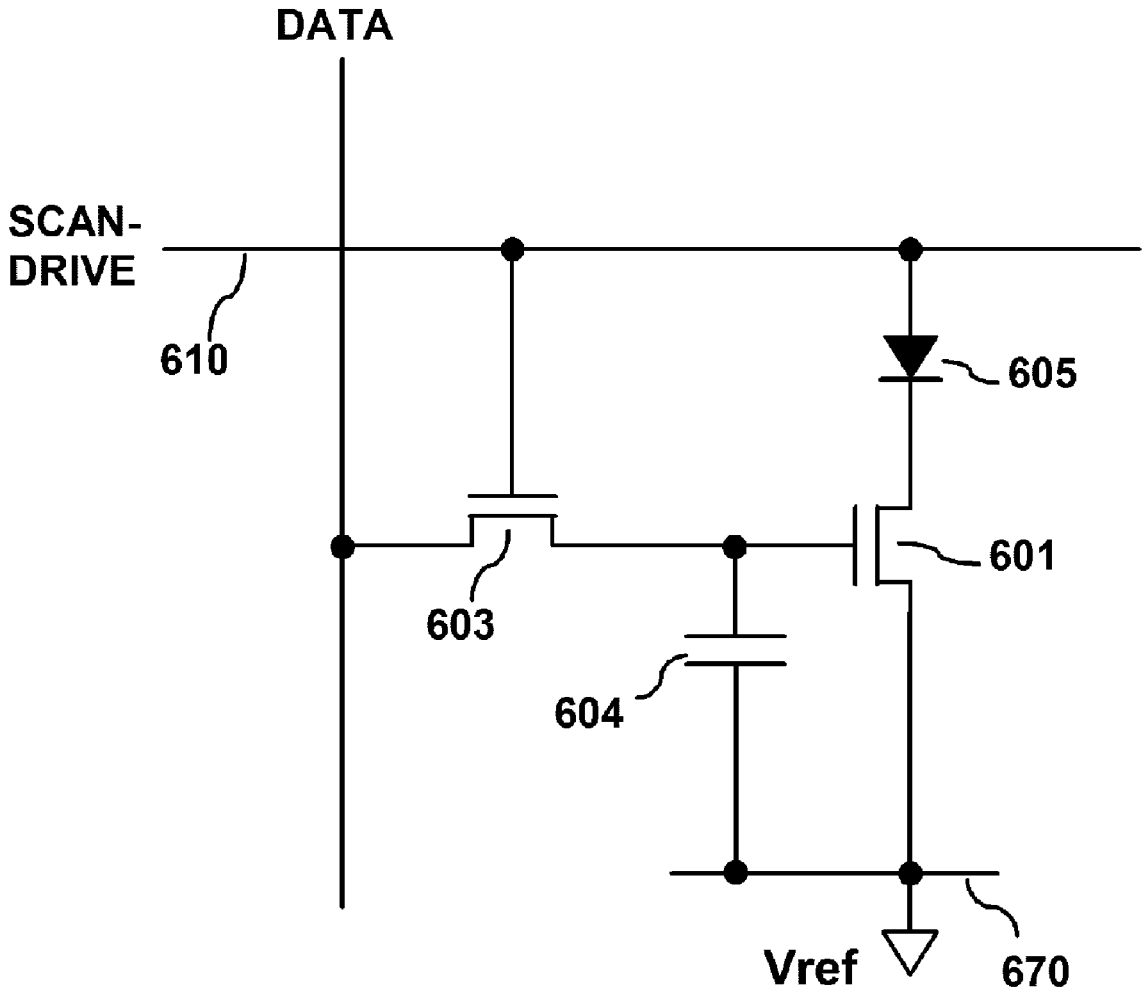
FIG. 6 is a schematic diagram of a pixel circuit in another embodiment of the present invention.

FIG. 6 illustrates an embodiment of a pixel circuit in a common anode configuration, wherein the anodes of all OLEDs in a row are connected to a common electrode. The pixel circuit comprises a p-channel transistor 603, an n-channel drive transistor 601, a capacitor 604, a light emitting diode 605, a scan-power electrode 610, and a voltage reference Vref 670. Vref is set to be the lowest voltage in the system. The operation procedure is similar to that of the circuit in FIG. 5. Since the capacitor, and the data voltage, is referenced directly to the same voltage as the source node of the transistor, typically, no additional offset voltage is required for data format. A typical data range is the same as the dynamic range of transistor 601, and references to voltage low.

Figure 3:
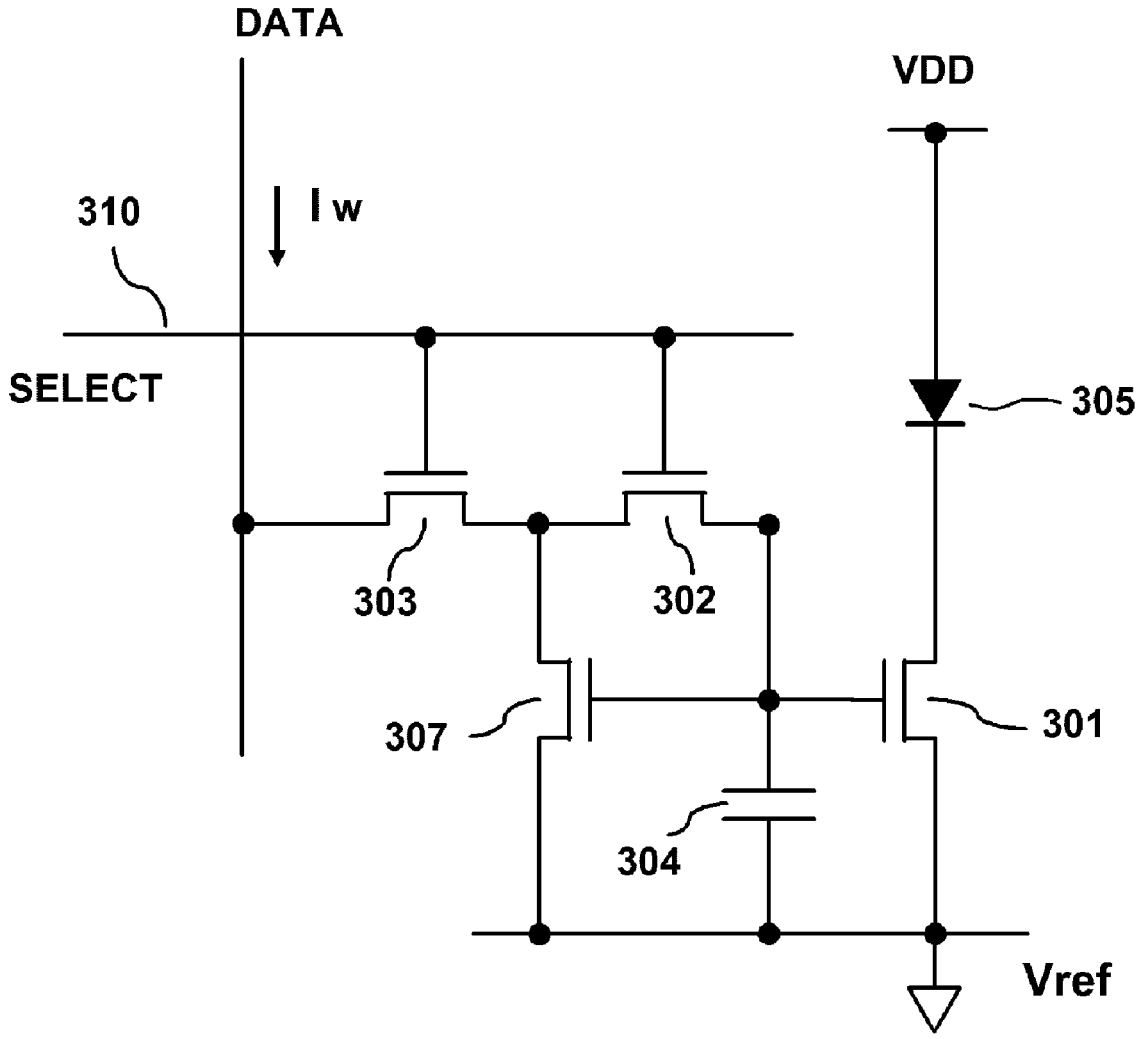
Fig. 3 (Prior Art)
FIG. 3 is a schematic diagram of a prior art pixel circuit in an active matrix light emitting device.
Figure 7:
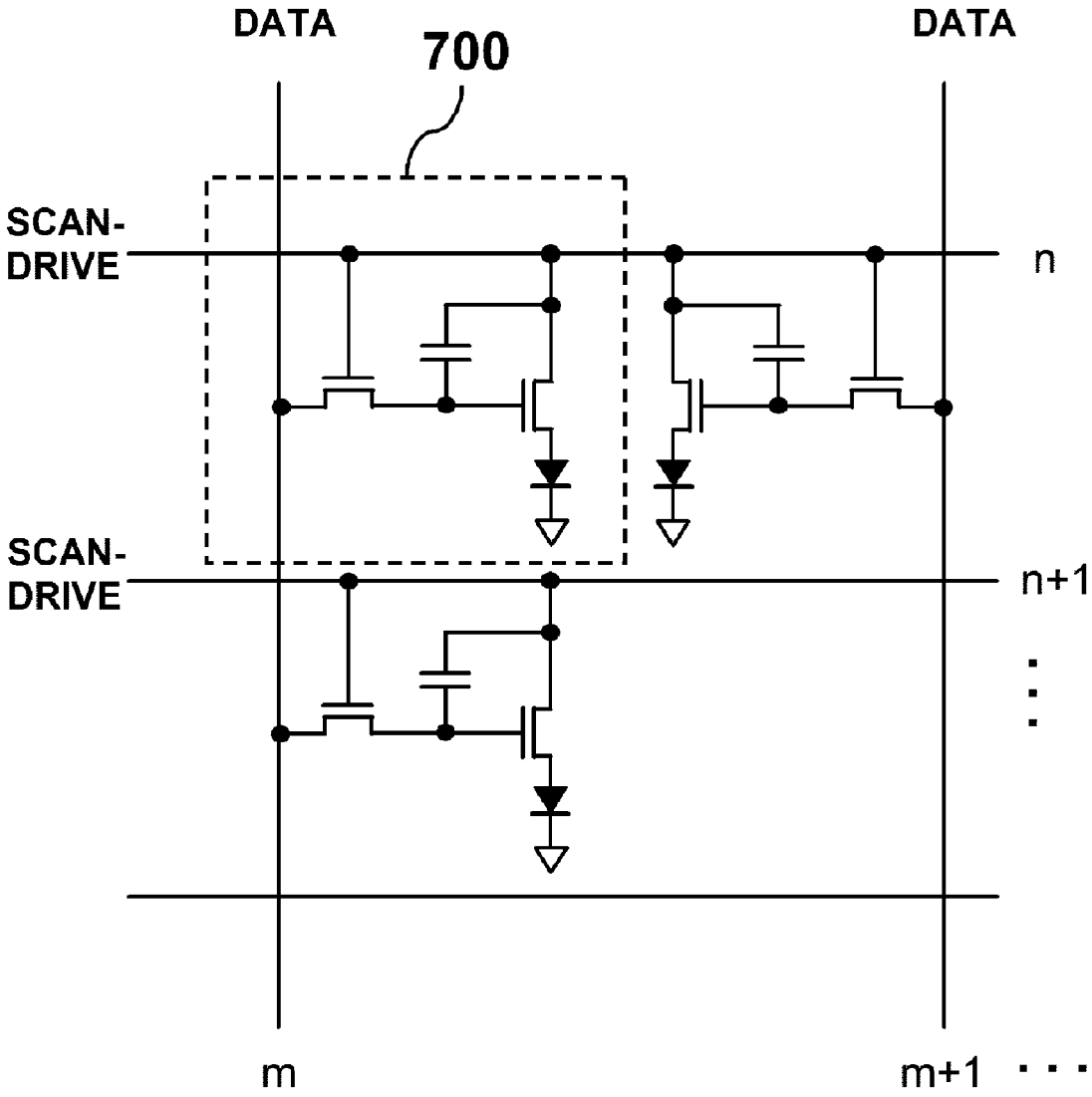
FIG. 7 is a schematic diagram of an active matrix light emitting device display in the present invention.

FIG. 7 is an embodiment of an active matrix OLED display, showing adjacent, n and n+1 rows, and m and m+1 columns. Pixel circuit of FIG. 4 is inserted as block 700 for illustration. Comparing to FIG. 3, VDD electrode of FIG. 3 is eliminated, thereby freeing more light emitting area.

Further extensions of the present invention may be achieved by altering pixel bias direction, and by combining dynamic drive of adjacent pixels. Preferred embodiments and respective benefits of such extension are provided herein.

Figure 8:
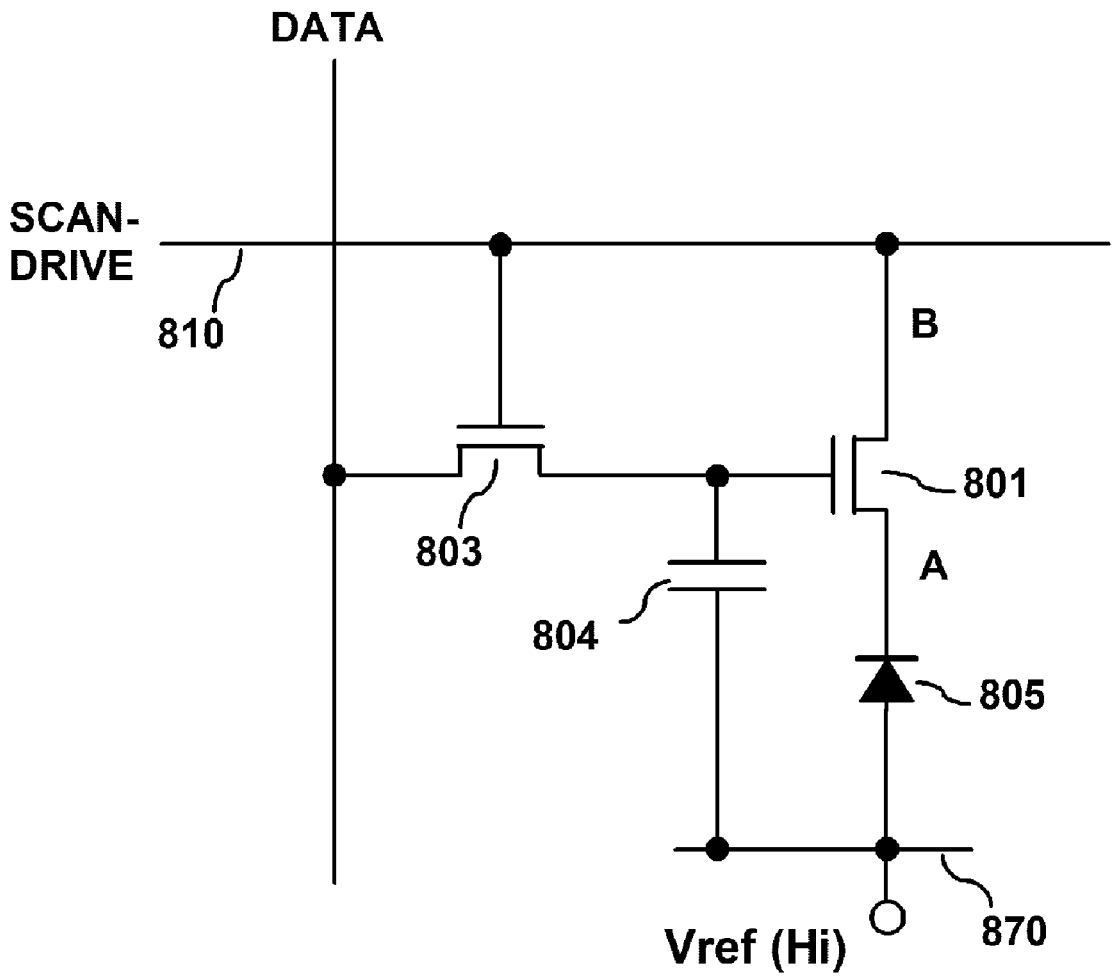
FIG. 8 is a schematic diagram of a pixel circuit utilizing two same-type transistors in the present invention. Data reference is the high-side voltage Vref.

FIG. 8 illustrates a preferred embodiment using an all n-channel devices in a pixel. The pixel circuit comprises an n-channel scan control transistor 803, an n-channel drive transistor 801, a capacitor 804, an OLED 805 in a common anode configuration with its anode connected to a most positive voltage reference Vref 870, and a scan-power electrode 810 performing dual operations. During a scan (write) cycle, a scan-power electrode is set high (same level as Vref) turning on n-channel transistor 803, and disabling transistor 801 because its source and drain ends are at the same voltage. Data is written and stored in capacitor 804. At the completion of data writing, voltage of the scan-power electrode is set low (to the lowest voltage in the system), turning off transistor 803, thereby isolating a pixel from external data signal. Setting voltage low on a scan-power electrode enables power on transistor 801, driving an output current according to the data voltage stored on the gate. Terminal B corresponds to the source, and terminal A is the drain. Gate-to-source control voltage $V_{GS}$ is equal to the data voltage measured from Vref, i.e. (Vref–$V_{Data}$).

In a preferred operating scheme, data voltage is formatted to be greater than the maximum operating forward voltage of OLED, or alternatively, Vref is set equal to, or slightly higher than the sum of the maximum gate voltage according to data format and the onset voltage of OLED. This bias condition ensures drain-to-source voltage drop $V_{DS}$ is greater than $V_{GS}$ in a drive cycle, thereby forcing transistor 801 into its saturation region.

A common cathode pixel may be constructed by varying the embodiment of FIG. 8, replacing the two n-channel transistors with two p-channel transistors, reconnecting the second terminal of the storage capacitor to the scan-power electrode (with the first terminal remains to the gate of the drive transistor), and reversing the polarity of OLED, voltage source and data.

Figure 9:
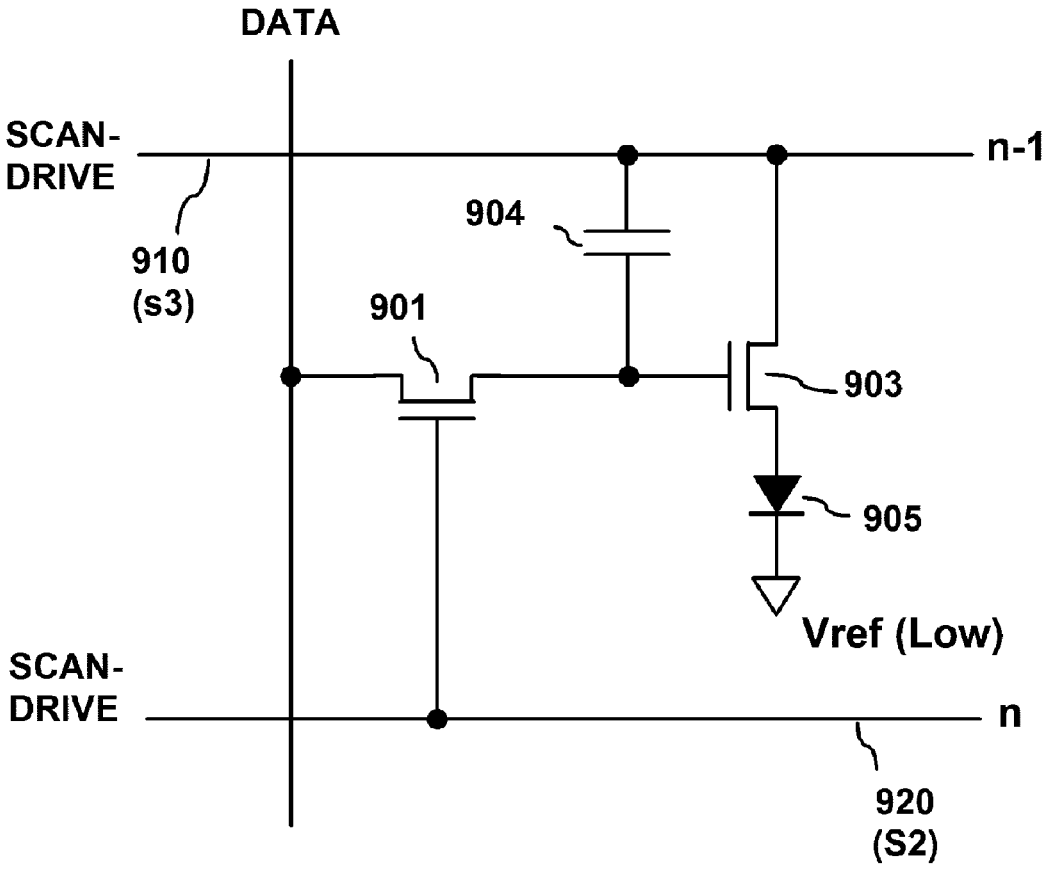
FIG. 9 is a pixel circuit in an embodiment utilizing two same-type transistors in the present invention, and having a capacitor structure formed with part of an adjacent scan-power electrode.

Considering efficiency in area utilization, a favorable embodiment of storage capacitor in a pixel circuit is a capacitor formed with the scan-power electrode conductor as part of the capacitor structure. A typical example of this is a capacitor formed underneath a scan-power bus line along one side of a pixel, having a thin layer of dielectric material between the scan-power bus electrode and another conductive layer underneath. In such embodiments, one capacitor terminal is connected to one of the two adjacent scan bus lines. FIG. 9 illustrates a preferred embodiment of such pixel circuit. This embodiment illustrates a common cathode configuration with two p-channel transistors 903 and 901. In a pixel belonging to the $n^{th}$ data electrode, the source of transistor 901 and the second terminal of capacitor 904 are connected to a preceding $(n-1)^{th}$ scan-power electrode. The gate of scan control transistor 903 is connected to the $n^{th}$ scan-power electrode. In a preferred operation, driving power for the $n^{th}$ row is enabled by setting the voltage on $n^{th}$ scan-power electrode high. During a data writing cycle for the $n^{th}$ row, voltage on $n^{th}$ scan-power electrode is set low, turning on p-channel transistor 903 and allowing data to be written and stored in capacitor 904. A scan cycle is terminated by setting the voltage of $n^{th}$ scan-power electrode high, turning off transistor 903 and isolating the capacitor from data electrode. Since the power source for drive transistor 901 and voltage reference for storage capacitor 904 are connected to the preceding scan-power electrode, the operation of drive transistor is not affected by a voltage swing on $n^{th}$ scan-power electrode. The power of $n^{th}$ row is only temporarily paused when the preceding $(n-1)^{th}$ scan electrode is set low in its scan cycle.

An all n-channel, common anode embodiment can be obtained by replacing the two p-channel transistors in FIG. 9 by n-channel transistors, and reversing the polarity of LED, power source, and data voltage.

The present invention is described hereinbefore with specific combinations of transistors and polarity of OLED in each embodiment. These embodiments illustrate a drive scheme and rules to implement pixels circuit within such scheme. Variances and extensions are expected to be derived from the present invention. For example, an implementation using three or four transistors in a pixel with light emitting element, utilizing the method of delivering driving current and performing scan selection with the same access lines (scan-power electrodes) will fall well within the teaching of the present invention. As another example, utilizing the fluctuation of voltage on a scanning electrode to achieve a dynamic configuration of same transistors so that drain and source terminals of a drive transistor are interchangeable according to the momentary bias configurations, as described in the embodiment of FIG. 4, in a three-transistor implementation, will also fall within the scope of the present invention.

Various preferred operating conditions with preferred reference voltages (Vref), are described in detail in this disclosure. The operation ranges described herein for the present invention shall not be construed as limitations to this invention. For example, the embodiment in FIG. 4 may be operated in a linear region by providing a positive offset voltage to the data signal explicitly or implicitly through reconnecting the second terminal of the storage capacitor to a scan-power electrode.

Although various embodiments utilizing the principles of the present invention have been shown and described in detail herein, those skilled in the art can readily devise many other variances, modifications, and extensions that still incorporate the principles disclosed in the present invention. The scope of the present invention embraces all such variances, and shall not be construed as limited by the number of active elements, wiring options of such, or the polarity of a light emitting device therein.

What is claimed is:

1. A display comprising:

a data electrode for delivering input data;

a scan-power electrode; said scan-power electrode delivering at least a first signal and a second signal in operating said display;

a reference voltage source;

a pixel disposed at the intersect of said scan-power electrode and said data electrode;

said pixel comprising:

a light emitting element; wherein said light emitting element emits light according to an electrical current supplied thereto;

a storage element for holding data information having a first and a second ends;

a control circuit being connected to said data electrode, at least a scan-power electrode, said storage element, and said light emitting element;

said control circuit comprising a switching element having a high-impedance control terminal, a second terminal, and a third terminal; said high-impedance control terminal being a gate or a base of a transistor;

said control terminal is connected to the first end of said storage element;

said control circuit writing said data information from said data electrode to said storage element during the period when said first signal is applied to said scan-power electrode;

said control circuit, in response to said second signal delivered via the same said scan-power electrode, inhibits data transfer between said data electrode and said storage element when said second signal is applied to said scan-power electrode;

wherein said control circuit further comprising a conducting channel for conducting electrical current between said scan-power electrode (S1) and said voltage source via said light emitting element;

wherein, in operation of said display, said conducting channel is enabled by applying a drive voltage on said scan-power electrode (S1), and wherein said conducting channel, when enabled, is modulated by said data information through said switching element of said control circuit;

wherein, in operation of said display, said conducting channel is inhibited by applying a disabling signal on said scan-power electrode (S1); and wherein said light emitting element is turned off when said conducting channel is inhibited;

wherein said conducting channel, when enabled, comprises at least a direct current path not ended on a capacitor in said pixel;

wherein, in operation of said display, said enabling and inhibiting operation of said conducting channel are controlled in its entirety by (1) said drive voltage and said disabling signal applied to said scan-power electrode and (2) said modulation by said data information through said switching element when said conducting channel is enabled.

2. The display according to claim 1, wherein said direct current path, when enabled, comprising a combination of the elements from the group consisting of: diode in forward bias, transistor via its drain and source, transistor via its collector and emitter, resistor, and conductive line.

3. The display according to claim 1, wherein said conducting channel, when enabled in operation of said display by applying said drive signal to said scan-power electrode, delivers a full amount of drive current to said light emitting element according to said data information held at said storage element.

4. The display according to claim 1, wherein said second terminal of said switching element operates as a drain in the period when said first signal applied to said scan-power electrode; wherein said second terminal of said switching element operates as a source in the period when said second signal applied to said scan-power electrode.

5. The method for driving the display according to claim 1, wherein said switching element is a transistor;

wherein said first signal sets said transistor in a first configuration wherein said second terminal of said transistor operates as a drain, and said third terminal of said transistor operates as a source;

wherein said second signal sets said transistor in a second configuration wherein said second terminal of said transistor operates as a source, and said third terminal of said transistor operates as a drain.

6. The display according to claim 1, wherein said disabling signal is said second signal, and wherein said second signal applied to said scan-power electrode inhibits said conducting channel.

7. The display according to claim 6, wherein said drive voltage is said first signal, and wherein said first signal applied to said scan-power electrode enables said conducting channel.

8. The display according to claim 7, wherein said scan-power electrode selects said pixel for data input during a write period when said first signal is applied to said scan-power electrode, and wherein said scan-power electrode delivers all required drive current according to said data information in said storage element during a drive period when said second signal is applied to said scan-power electrode.

9. The display according to claim 1, wherein all said structures of said pixel are fabricated on one surface of a substrate material.

10. The display according to claim 9, wherein said control circuit further comprises a second switching element, wherein said first signal carried by said scan-power electrode turns on said second switching element allowing a data information to be received at said storage element from said data electrode; and wherein said second signal carried by said scan-power electrode turns off said second switching element to inhibit the data transfer from said data electrode.

11. The display according to claim 9, wherein said light emitting element is an organic light emitting device.

12. The display according to claim 9, wherein said organic light emitting device is a light emitting diode.

13. The display according to claim 1, wherein during a data writing period when said first signal is applied to said scan-power electrode, a charging current arising from data writing is directed into said storage element; said charging current being directed from said data electrode to said scan-power electrode via said switching element.

14. The display according to claim 13, wherein said first signal applied to said scan-power electrode causes the second end of said storage element to be set to the voltage of said scan-power electrode via the connection of said switching element to said scan-power electrode.

15. The display according to claim 13, wherein said second end of said storage element connects to said second terminal of said switching element, and said third terminal of said switching element is connected to said scan-power electrode.

16. The method for operating the display according to claim 13 to provide reference voltage to said storage element; said method comprising the following steps:

applying a first voltage to said scan-power electrode; wherein said first voltage enables data input; wherein said first voltage causes said storage element to discharge to said scan-power electrode via said transistor;

said discharge causing said second end of said storage element to approach a voltage equal to said first voltage;

applying a second voltage to said scan-power electrode; wherein said second voltage causes the first end of said storage to be isolated, and the second end of said storage element to be floating, said floating voltage being determined by the current flow from said scan-power electrode to said voltage reference via said light emitting element.

17. A display comprising a plurality of data electrodes, a plurality of scan-power electrodes, a reference voltage source, a plurality of pixels, wherein each said pixel is connected to: one said data electrode, a first scan-power electrode, and said voltage reference;

wherein each said pixel comprises at least:

a light emitting element;

a first switching element for controlling the current to be supplied to said light emitting element according to a data information written in said pixel; said first switching element having a gate, a second and a third terminals;

a second switching element comprising a gate, a second and a third terminals; said gate of said second switching element being connected to, and controlled by, a second scan-power electrode connected to said pixel;

a storage element for holding data information written in said pixel; said light emitting element emits light with light according to a electrical current supplied thereto;

wherein said first scan-power electrode and said second scan-power electrode provide:

a data input channel from said data electrode to said storage element during the period when a first signal is applied to said second scan-power electrode;

a current path between said first scan-power electrode (S1) and said voltage source via said light emitting element during the period when a second signal is applied to said first scan-power electrode;

wherein said first scan-power electrode and said second scan-power electrode operate to inhibit:

said data input channel from said data electrode to said storage element during the period when said second signal is applied to said second scan-power electrode, whereby inhibits the influence of said data information from said data electrodes on said subset of pixels;

said current path between said first scan-power electrode (S1) and said voltage source via said light emitting element during the period when said first signal is applied to said first scan-power electrode.

18. The display according to claims 17, wherein said first scan-power electrode and said second scan-power electrode are the same electrode.

19. The display according to claim 17, wherein said switching elements are transistors formed on any one of the following structures: a layer of amorphous silicon; a layer of polycrystalline silicon; single crystal silicon substrate.

20. The display according to claim 17, wherein said first switching element is an nMOS having a gate, a second, and a third terminals;

wherein said second switching element is a pMOS having a gate; a second terminal, and a third terminal;

wherein said light emitting element has a first and a second terminals;

wherein said storage element is a capacitor having a first and a second terminals;

said gate terminal of said nMOS being connected to said second terminal of said pMOS, and to the first terminal of the capacitor;

the gate of said pMOS being connected to a scan-power elecrode;

the third terminal of said pMOS being connected to a said data electrode;

the second terminal of said capacitor being connected to the second terminal of said nMOS;

the third terminal of said nMOS being connected to a scan-power electrode;

the first terminal of said light emitting element being connected to said Vref;

the second terminal of said light emitting element being connected to the second terminal of said nMOS.

21. The display according to claim 17, wherein said light emitting element has a first end and a second end, wherein said first end of said light emitting element is connected to said first switching element, and said second end is connected to said reference voltage source.

22. The display according to claim 17, wherein said reference voltage source is supplied through an electrode comprising a conductive layer connecting all pixels.

23. The display according to claim 17, wherein said light emitting element is an organic light emitting device.

24. The display according to claim 17, wherein said light emitting element is an organic light emitting diode.

25. The display according to claim 17, wherein said light emitting element is an organic light emitting device having bi-directional conduction.

26. The display according to claim 17, wherein said first scan-power electrode and said second scan-power electrode are two adjacent scan-power electrodes, connecting to three adjacent rows of pixels in the following manner:

said first scan-power electrode connects the gate of said second switching element in each of the pixels of the first row, and the drain terminal of said first switching element in each of the pixels of the second row, said second scan-power electrode connects the gate of said second switching element in each of the pixels of the second row, and the drain terminal of said first switching element in each of the pixels of the third row.

27. The display according to claim 17 further comprising a driver, wherein said driver comprising a plurality of output terminals, each said output terminals being connected to a said scan-power electrode;

wherein said driver provides said first and second signals to each of said scan-power electrodes according to a timing sequence, and wherein said driver provides said drive current to said light emitting elements via said scan-power electrodes.

28. The display according to claims 17, wherein said storage element for holding data information is a capacitor having a first end and a second end, wherein the first end of said capacitor is connected to said gate of said first switching element, and to the second terminal of said second switching element.

29. The display according to claim 28, wherein said capacitor is formed by parasitic elements with inherent connections.

30. A method for driving a display comprising a plurality of data electrodes, a plurality of scan-power electrodes, a reference voltage source, a plurality of pixels, wherein each said pixel is connected to: one said data electrode, a first scan-power electrode, and said voltage reference;

wherein said pixel comprises at least:

a light emitting element;

a first active element for controlling the current to be supplied to said light emitting element according to a data information written in said pixel;

a second active element comprising a gate, a second and a third terminals; said gate of said second active element being connected to, and controlled by, a second scan-power electrode connected to said pixel;

a storage element for holding data information written in said pixel;

wherein said light emitting element emits light with light output varies according to electrical current supplied thereto;

said method comprising the steps of operating said display; said steps comprising the following operations:

applying a first electrical signal to said second scan-power electrode, wherein said first electrical signal selects the subset of pixels connected to said scan-power electrode by turning on the second active element in each of said subset of pixels to allow writing data information in said selected pixels from the data electrodes connected to said pixels;

applying a second electrical signal to said first scan-power electrode, wherein said second electrical signal drives a current from said first scan-power electrode to the light emitting elements in said subset of pixels for producing light output according to the data information;

applying said first electrical signal to said first scan-power electrode, wherein said first electrical signal terminates delivery of electrical power to said light emitting elements connected to said scan-power electrode;

applying said second electrical signal to said second scan-power electrode, wherein said second signal turns off said second active element in each of said subset pixels, whereby inhibits the influence of said data information from said data electrodes on said subset of pixels.

31. The method according to claim 30, wherein said second scan-power electrode and said first scan-power electrode are the same scan-power electrode.

32. The method according to claim 30, wherein said first electrical signal is applied sequentially to said scan-power electrodes.

33. The method according to claim 30, wherein said first and second active element are transistors.

* * * * *